US005913092A

United States Patent [19]

Bisaiji et al.

[11] Patent Number: 5,913,092

[45] Date of Patent: Jun. 15, 1999

[54] PICTURE DESIGN FORMING SYSTEM AND METHOD TONER FOR FORMING AN IMAGE, TRANSFERRING SUBSTANCE FOR FORMING A PICTURE DESIGN

[75] Inventors: Takashi Bisaiji, Yokohama; Takeyoshi Sekine, Tokyo; Satoshi Hatori, Tokyo; Jun Okamoto, Tokyo; Mitsuru Takahashi, Kawasaki, all of Japan

[73] Assignee: Ricoh Company, Ltd., Tokyo, Japan

[21] Appl. No.: 08/805,226

[22] Filed: Feb. 24, 1997

[30] Foreign Application Priority Data

Feb. 29, 1996 [JP] Japan ..... 8-071489

[51] Int. Cl.[6] ..... G03G 15/00; G03G 21/00; G03G 9/00

[52] U.S. Cl. ..... 399/49; 430/110

[58] Field of Search ..... 399/29, 30, 49; 430/109, 110, 124, 137

[56] References Cited

U.S. PATENT DOCUMENTS 5,558,969 9/1996 Uyttendaele et al. ..... 430/124
5,559,592 9/1996 Larson et al. ..... 399/328
5,579,090 11/1996 Sasanuma et al. ..... 399/49
5,582,950 12/1996 Katagiri et al. ..... 430/137
5,697,012 12/1997 Sasanuma et al. ..... 399/49
5,701,566 12/1997 Bisaigi et al. ..... 399/302

FOREIGN PATENT DOCUMENTS 2-118670 5/1990 Japan .
3-177848 8/1991 Japan .

*Primary Examiner*—Fred L. Braun
*Attorney, Agent, or Firm*—Oblon, Spivak, McClelland, Maier & Neustadt, P.C.

[57] ABSTRACT

A picture design forming operation detects an adhering amount of toner by an optical sensor in an image forming apparatus. Image forming conditions are controlled on the basis of the detection result and a toner image is formed on a member. The toner image is then transferred to a transferring substance. The transferring substance is then attached to a picture design forming object and is sintered in this state. Further, a light absorbing material which has absorbency to light of a wavelength used in the optical sensor is contained in the toner, and resolves at least at a temperature of the sintering process.

15 Claims, 6 Drawing Sheets

PICTURE DESIGN FORMING SYSTEM AND METHOD TONER FOR FORMING AN IMAGE, TRANSFERRING SUBSTANCE FOR FORMING A PICTURE DESIGN

BACKGROUND OF THE INVENTION

Field of the Invention

The present invention relates to a picture design forming system for forming a picture design on a ceramic, an enamel, a glass, etc., a toner for forming the image, and a transferring substance for forming a picture design.

DISCUSSION OF THE BACKGROUND

An adopted method uses a transferring substance in order to form a picture design on a picture design forming object such as ceramic, enamel, glass, etc., substrate. FIG. 5 shows a forming method of transferring a substance and forming a picture design onto a picture design forming object such as a ceramic substrate.

First, as shown in FIG. 5(*a*) a water soluble paste layer 902 is formed on a paste board 901. As shown in FIG. 5(*b*) a picture design layer 903 is then formed on a surface of this paste layer 902 by, for example, a screen printing. As shown in FIG. 5(*c*) a compound resin is then coated on the surfaces of the paste layer 902 and the picture design layer 903 to form a resin layer 904. Thereby, a transferring substance 900 is completed. When the picture design is formed on the picture design forming object by using the transferring object 900 made by this method, first, as shown in FIG. 5(*d*), the transferring substance 900 is placed in water and the paste layer 902 is dissolved, and then the resin layer 904 with the picture design layer 903 is released from the paste board 901. As shown in FIG. 5(*e*) this resin layer 904 with the picture design layer 903 is then attached to a picture design forming object 905 such as a ceramic substrate. Then, as shown in FIG. 5(*f*) the resulting structure is sintered. Thereby, a picture design is formed on the picture design forming object 905 such as the ceramic substrate.

The process for forming the picture design layer 903 in FIG. 5(*b*) is ordinarily achieved by a screen printing. However, since screen printing requires a great amount of time to form a plate, etc., screen printing is not suitable for many applications and is not suitable for small amounts of production.

Therefore, it has been proposed to form a picture design layer by using a dry type printing by a dry copying machine, see for example Japanese Laid Open Patents 1992-135,798 and 1995-199,540.

As an image forming apparatus such as a copying machine, facsimile machine, or printer etc., a machine in which adhered toner on a member is detected by an optical sensor and in which image forming conditions are controlled based on such a detection result is widely used. For example, in an image forming apparatus which uses two-components developer, which includes a toner and a carrier, an adhering amount of the toner on a reference pattern formed on a photoconductive drum is detected by an optical sensor, and a toner supply to a developing device is controlled based on the detection result so that toner density in the developing device is within a predetermined range. Further, a charge potential of the photoconductive drum by a uniform charging device or an exposing amount of an exposing device are controlled based on the detected result.

In the control operation using such an optical sensor, light from an emission device of the optical sensor is incident to toner on a member, and a reflecting light or a transmitting light therefrom is detected, and then an adhering amount of toner is determined from an intensity of the reflecting light or the transmitting light. However, such an operation has a disadvantage in that not enough sensitivity in detecting the adhering amount of the toner is obtained if specific wavelengths of the light in the optical sensor or specific kinds of toner are used. For example, when an adhering amount of color toner such as black, cyan, magenta, yellow, blue, red or green toner is detected by using an infrared light of approximately 950 nm, and FIG. 6 shows specific examples of detecting black toner and red toner, there is a disadvantage that adequate sensitivity in detecting the black toner can comparatively be obtained, however, enough sensitivity in detecting the red toner is not obtained. As described above, if not enough sensitivity in detecting the adhering amount of the toner is obtained, controlling image forming conditions becomes unstable and a high quality image cannot be obtained.

SUMMARY AND OBJECT OF THE INVENTION

Accordingly, one object of the present invention is to provide a picture design forming system for forming a picture design on a substrate, for example of ceramic, enamel, glass, etc., a toner for forming an image, and a transferring substance for forming a picture design, where an adhering amount of a toner on a member can be sensitively detected by an optical sensor and a toner image of high quality can be stably formed on the basis of the detection result, and in which a quality of a picture design formed by a sintering process of the toner is not reduced.

The controlling of image forming conditions by using an optical sensor is also necessary when the toner image for forming a picture design described above is to be formed to be stable.

However, when this toner image is sintered in the state that it is attached on the picture design forming object, the inventors of the present invention have recognized that the following special circumstance exists. Namely, if at least a thermal sintering colorant in the toner for forming an image is left on the picture design forming object after the sintering process, the picture design can be formed on the picture design forming object. Therefore, the inventors of the present invention have paid attention to a point that a material having a desired property can be contained because of this special circumstance if it can be resolved at the above sintering processing temperature, and the inventors of the present invention have thereby solved the disadvantage in the detection of the adhering amount of the toner.

These and other objects and advantages are achieved by the present invention which provides a picture design forming method for forming a picture design including detecting an adhering amount of toner by an optical sensor in an image forming apparatus, controlling image forming conditions on the basis of the detection result and forming a toner image on a member, transferring the toner image to a transferring substance, attaching the transferring substance to a picture design forming object and then sintering in this state, and wherein a light absorbing material which has an absorbency to a light of wavelength used in the optical sensor is contained in the toner, and resolves at least a temperature of the sintering process.

BRIEF DESCRIPTION OF THE DRAWINGS

In describing the preferred embodiments of the present invention illustrated in the drawings, specified terminology is employed for the sake of clarity. However, the present invention is not intended to be limited to the specific terminology so selected, and it is to be understood that each specific element includes all technical equivalents which operate in a similar manner.

A more complete appreciation of the present invention and many of the attendant advantages thereof will be readily obtained as the same becomes better understood by reference to the following detailed description, particularly when considered in connection with the accompanying drawings, wherein.

DESCRIPTION OF THE PREFERRED EMBODIMENT

Figure 1:
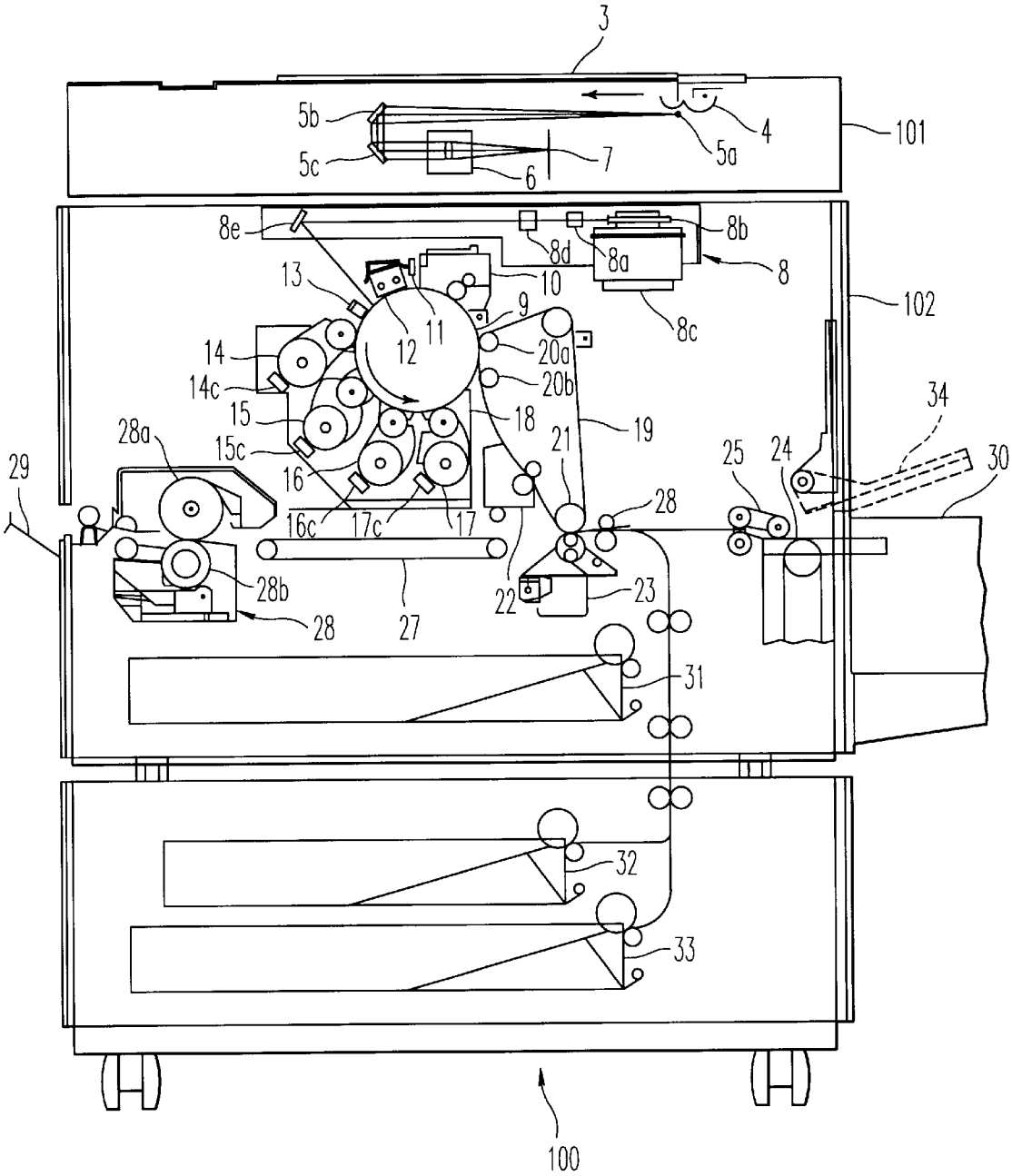
FIG. 1 is an elevational view showing a structure of a color copying machine of an embodiment in the present invention.

Referring now to the drawings, an embodiment of a color copying machine as an image forming apparatus to which the present invention is applicable will be described.

Figure 2:
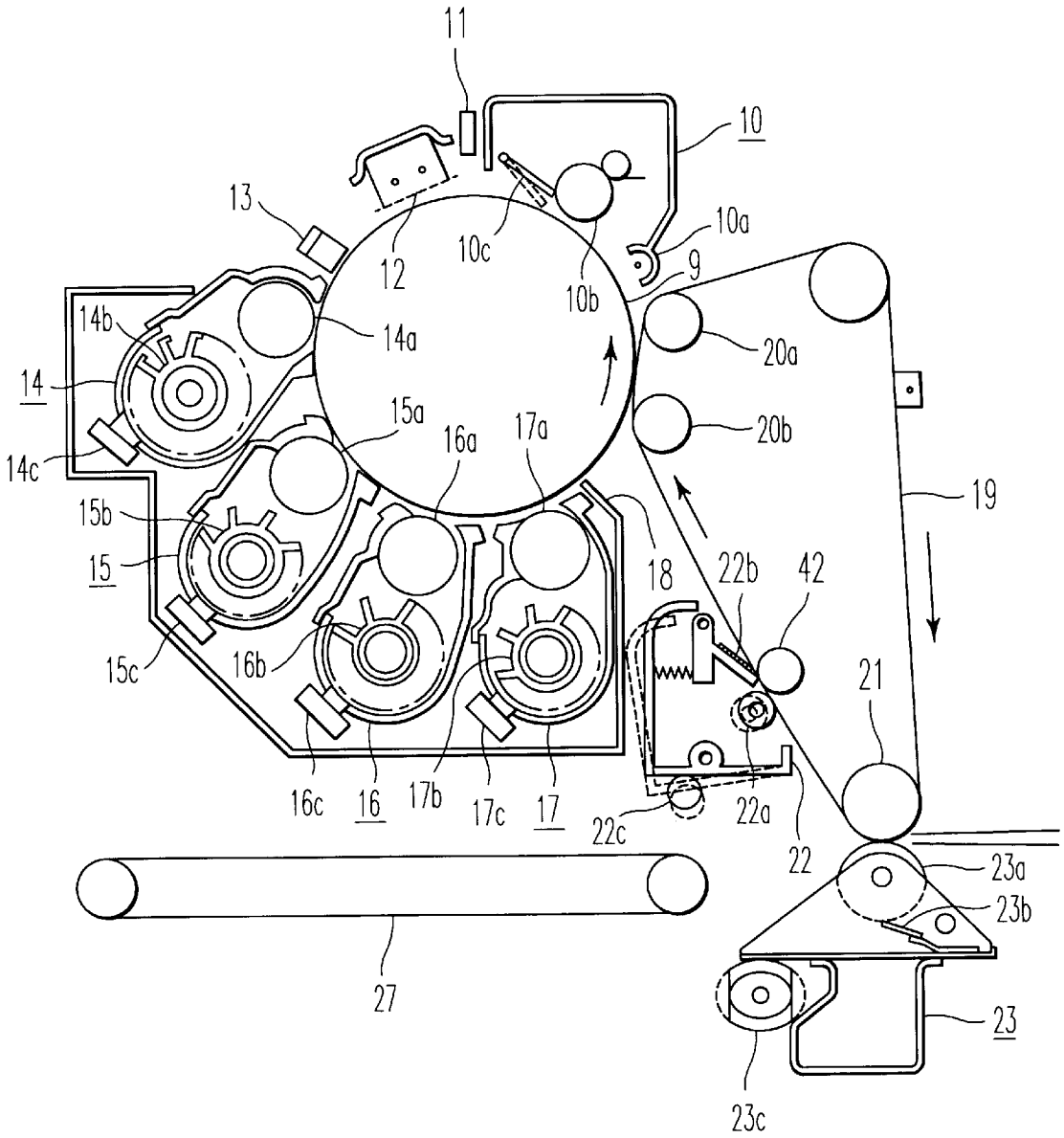
FIG. 2 is an enlarged view around a photoconductive drum and an intermediate transfer belt in the color copying machine.

FIG. 1 is an outline view showing a structure of a color copying machine of an embodiment of the present invention, and FIG. 2 is an enlarged view around a photoconductive drum and an intermediate transfer belt of the color copying machine.

As shown in FIGS. 1 and 2, the copying machine is generally made up of a color image scanner 101 and a color printer 102. The scanner 101 has a lamp 4 for illuminating a document 3. The resulting reflection from the document 3 is incident to a color image sensor 7 via mirrors 5*a*, 5*b* and 5*c*, and a lens 6. The image sensor 7 reads the colors, e.g., blue (B), green (G) and red (R), of the incident imagewise light one by one, while converting them to electric image signals.

The scanner 101 includes an image processing section, not shown, for producing black (Bk), cyan (C), magenta (M) and yellow (Y) color image data on the basis of the intensity levels of the read B, G and R image signals. The printer 102 prints out the BK, C, M and Y color image data by using Bk, C, M and Y toner, respectively. The resulting toner images are sequentially superposed to complete a four-color or full-color image.

Specifically, the printer 102 has an optical writing unit for transforming the color image data fed from the scanner 101 to optical signals, and optically writing the document image represented by the optical signals. The writing unit has a laser 8*a* and a polygonal mirror 8*b*. While the polygonal mirror 8*b* is rotated by a motor 8*c*, a laser beam issuing from the laser 8*a* is steered by the mirror 8*b* and is incident to a photoconductive drum 9 via an f-theta lens 8*d* and a mirror 8*e*. As a result, the laser beam electrostatically forms a latent image representative of the document image on the drum 9, for example OPC.

The drum 9 is rotated counterclockwise, as indicated by an arrow in FIGS. 1 and 2. Several units are arranged around the drum 9 including a drum cleaning unit (including a precleaning discharger) 10, a discharge lamp 11, a charger 12, a potential sensor 13, a Bk developing unit 14, a C developing unit 15, a M developing unit 16, a Y developing unit 17, a density pattern optical sensor 18, an intermediate transfer member, for example in the form of a belt 19, and other conventional units for effecting an electrophotographic copying cycle. A pretransfer discharger 10*a* may also be positioned in the vicinity of the drum 9. As shown in FIG. 2, the developing units 14–17 respectively have developing sleeves 14*a*, 15*a*, 16*a* and 17*a*, paddles 14*b*, 15*b*, 16*b* and 17*b*, and toner density sensors 14*c*, 15*c*, 16*c* and 17*c*. The sleeves 14*a* to 17*a* are rotatable and are located to face the drum 9. The paddles 14*b* to 17*b* are each rotatable to scoop up a respective developer while agitating it.

The operation of the copying machine will be described on the assumption that a BK image, C image, M image and Y image are sequentially formed in this order, although such an order is only illustrative.

On the start of a copying operation, the scanner 101 starts reading Bk image data out of a document at a predetermined timing. A laser beam starts forming a latent image on the drum 9 on the basis of the Bk image data. The latent image derived from the Bk image data will be referred to as a BK latent image. This operation is also implemented for latent images based on C, M and Y image data. In the Bk developing unit 14, the sleeve 14*a* starts rotating before the leading edge of the Bk latent image arrives at the developing position of the unit 14. In this condition, the developing unit 14 develops the Bk latent image from the leading edge to the trailing edge with Bk toner. As soon as the trailing edge of the Bk latent image moves away from the developing position, the developing unit is rendered inoperative. These operations are completed at least before the leading edge of the following C latent image reaches the developing unit 14.

The Bk toner image formed on the drum 9 is transferred to the intermediate transfer belt 19 which moves at a same speed as the drum 9. The image transfer from the drum 9 to the belt 19 will be referred to as belt transfer hereinafter. For the belt transfer, a predetermined bias voltage is applied to a bias roller 20*a* located at a position where the drum 9 and belt 19 contact each other. This position will be referred to as a belt transfer position hereinafter.

The Bk, C, M and Y toner images sequentially formed on the drum 9 are sequentially transferred to the same area of the belt 19 one above the other, thereby completely forming a full-color image on the belt 19. Subsequently, the full-color image is bodily transferred from the belt 19 to, e.g., a paper sheet. The configuration and operation of a belt unit including the belt 19 will be described specifically later.

The Bk image forming step effected with the drum 9 is followed by a C image forming step. The scanner 101 starts reading C image data out of the document at a predetermined timing. A laser beam then forms a C latent image on the drum 9 in response to the C image data.

In the C developing unit 15, the sleeve 15*a* starts rotating after the trailing edge of the Bk latent image has moved away from the developing position of the unit 15, but before the leading edge of the C latent image arrives at the developing position. After the development of the C latent image, the developing unit 15 is rendered inoperative when the trailing edge of the C latent image has moved away from the developing position. These operations are also completed before the leading edge of the following M latent image reaches the developing position.

A M latent image and a Y latent image are then formed and developed in the same manner as the BK and C latent images. These operations will not be described specifically in order to avoid redundancy.

The intermediate transfer member including the intermediate transfer belt 19 is constructed and operates as follows. The belt 19 is passed over a drive roller 21, the previously mentioned bias roller 20*a*, and a plurality of driven rollers (not numbered). The belt 19 is controllably driven by a stepping motor, not shown, via the drive roller 21, as will be described later.

As shown in FIG. 2, a belt cleaning unit 22 has a brush roller 22*a*, a rubber blade 22*b*, and a mechanism 22*c* for moving the unit 22 into and out of contact with the belt 19. During the belt transfer of the C, M and Y toner images following the belt transfer of the Bk image, the mechanism 22*c* maintains the cleaning unit 22 spaced apart from the belt 19. Then, images of the four colors are positioned precisely on the belt 19 and the image of each color is transferred one by one, and a full-color image is formed.

A paper transfer unit 23 has a bias roller 23*a*, a roller cleaning blade 23*b*, and a mechanism 23*c* for moving the unit 23 into and out of contact with the belt 19. The bias roller 23*a* is usually spaced apart from the belt 19. In the event when the full color image formed on the belt 19 is transferred to a paper, the mechanism 23*c* urges the bias roller 23*a* against the belt 19 at a predetermining timing. In this condition, a preselected bias voltage is applied to the roller 23*a* in order to transfer the color image from the belt 19 to the paper.

As shown in FIG. 1, a paper 24 is fed to a registration roller 26 by a pick-up roller 25. The registration roller 26 drives the paper 24 toward a paper transfer position where the bias roller 23*a* faces the belt 19, at such a timing that the leading edge of the color image on the belt 19 reaches the paper transfer position.

As shown in FIG. 1, the paper 24 carrying the full-color image thereon is then conveyed by a conveying unit 27 to a fixing unit 28. In the fixing unit 28, a heat roller 28*a* controlled to a predetermined temperature and a press roller 28*b* cooperate to fix the toner image on the paper 24 with heat and pressure. The paper 24 output of the fixing unit 28 is then guided to a copy tray 29.

After the belt transfer, the drum 9 is cleaned by the drum cleaning unit 10, i.e., precleaning discharger 10*a*, brush roller 10*b* and rubber blade 10*c*, and is then uniformly discharged by the discharge lamp 11. On the other hand, after the transfer of the full-color image from the belt 19 to the paper 24, the cleaning unit 22 is again urged against the belt 19 by the mechanism 22*c* and cleans the surface of the belt 19.

In a repeat copy mode, the operation of the scanner 101 and the image formation on the drum 9 proceed from the step of forming the first Y (fourth color) toner image to a step of forming the second Bk (first color) toner image at a predetermined timing. The second Bk toner image is transferred to the area of the belt 19 which has been cleaned by the cleaning unit 22. This is followed by the procedure previously described in relation to the first Bk toner image and the above described further procedures.

As shown in FIG. 1, paper cassettes 30, 31, 32 and 33 are each loaded with paper of particular sizes. Paper is sequentially fed from one of the cassettes 30–33 selected on an operation panel, not shown, toward the registration roller 26. The reference numeral 34 designates a manual feed tray available for OHP (Overhead Projector) sheets and thick sheets. A process speed is set to, for example, 180 mm/sec.

In a three-color or two-color copy mode, as distinguished from the full-color copy mode, the above procedure is repeated a number of times equal to the number of colors selected.

In a single-color copy mode, one of the developing units matching a desired color is continuously held operative until a desired number of copies have been produced. In this case, the belt 19 is continuously moved forward at a constant speed in contact with the drum 9. Also, the belt cleaning unit 22 is held in contact with the belt 19.

As each toner of C, M and Y used in this embodiment, a toner including a thermal sintering colorant and a binder resin, which is referred to as a ceramic toner hereinafter, can be used. By using this toner, an image which is formed on a transferring medium by a copying machine is sintered to a transferring object, such as a ceramic substrate, etc., and thereby the image can be finally formed on a surface of the transferring object.

In this embodiment, the image is developed by a two-components developing method, in which an electrostatic image is developed by using a two-components developer including the ceramic toner and a carrier. However, a developing unit can be structured by a single-component developing method, in which the electrostatic image is developed by using the ceramic toner only. As the carrier in the two-components developing method, a carrier similar to a background one such as iron, ferrite, or glasspiece, etc., can be illustrative. Such carriers can be covered with resin. The resin used in this case may be polycarbon fluoride, polyvinyl chloride, polyvinyliden chloride, phenol resin, polyvinyl acetal, or silicon resin etc. In every case, as a mixing ratio between the ceramic toner and the carrier, 1–15 parts of the ceramic toner with respect to 100 parts of the carrier is proper.

The ceramic toner used in this embodiment is composed of at least the thermal sintering colorant and the binder resin as a main component. Preferably mineralizer, sintering material, or flux are added to this ceramic toner.

As the thermal sintering colorant described above, there are iron oxide red or chromium green etc. as metal oxide, there are manganese pink, chromium-alumina green, chromium titanium yellow, vanadium-titanium yellow, antimonytin gray-blue, lilac, or vanadium-zirconium yellow etc. as solid solution of metal oxide, there are $(Zn, Co)O.Al_2O_3$, $ZnO.(Al, Cr)_2O_3$, $(Zn, Co)O.(Al, Cr)_2O_3$, $ZnO\ (Al, Cr, Fe)_2O_3$, $MnO.Cr_2O_3$, $(Mn, CO)O.(Cr, Fe)_2O_3$, or $CuO.Cr_2O_3$ etc. as double oxide, and there is antimony yellow etc. as solid solution of double oxide. Further, there are cobalt orpiment, nickel orpiment, or uvarovite etc. as silicate, there are chromium-tin pink, vanadium blue, turquoise blue, praseodymium yellow, or coral red etc. as solid solution of silicate, there is cadmium orange etc. as sulfide, and there are cadmium red, selenium red, or mandarin etc. as selenite.

In order to improve fusibility of the thermal sintering colorant, a mineralizer can be used. As the mineralizer, hydroxide of alkaline metal or alkaline-earth metal such as lithium hydroxide etc., carbonate of alkaline metal or alkaline-earth metal such as lithium carbonate etc., chloride of alkaline metal or alkaline-earth metal such as aluminum chloride, boric acid or boride of alkaline metal or alkaline-earth metal, metaboride of alkaline metal or alkaline-earth metal, orthophosphate of alkaline metal or alkaline-earth metal, pyrophosphate of alkaline metal or alkaline-earth metal, silicate of alkaline metal or alkaline-earth metal, metasilicate of alkaline metal or alkaline-earth metal such as zirconium silicate, metal oxide such as bone, borax, metavanadic acid ammonium, tungsten oxide, vanadium pentoxide, tin oxide, zirconium oxide, cerium oxide, molybdenum oxide etc., metal fluoride such as calcium fluoride, aluminum fluoride, glasslet, etc., are basis material, and individually or a mixture of plural ones of them are adopted.

As the sintering material, feldspar such as anorthite, microcline, albite, petalite (lithium feldspar), kaolin, silica rock, alumina, silica, quartz, titanium oxide, chamotte etc., are basic materials, and individually or a mixture of plural ones of such can be adopted.

Moreover, as an adjusting agent of saturation, lightness, or hue of a sintering image, a flux can be applied. As the flux, a natural mineral such as lime stone, magnesite, talc, or dolomite etc., or a chemical compound such as barium oxide, zinc oxide, or strontium carbonate, etc., are basic materials, and individually or a mixture of plural ones of such can be adopted.

Though a mineralizer, sintering material, or flux are not absolutely necessary because of a property or component of the transferring medium or a composition of the sintering object which are used in the method of the present invention, the mineralizer, the sintering material, and the flux are preferably used together with the thermal sintering colorant in order to heighten versatility. Further, these can be mixed previously, or can be dissolved after being mixed and therefore so called frit can be produced.

In order to obtain a proper charging property as a toner for electrophotography or a proper fixing property onto the transferring medium, a total amount of the thermal sintering colorant, the mineralizer, the sintering material, and the flux is preferably 120 parts or less with respect to the binder resin of 100 parts. Individually, with respect to the binder resin of 100 parts, the thermal sintering colorant of 1–120 parts, preferably 10–100 parts, is used. Moreover, mineralizer of 0–100 parts, sintering material of 0–40 parts, and the flux of 0–40 parts are proper.

As to a material other than the thermal sintering colorant, the mineralizer, the sintering material, and the flux described above, all known materials can be used.

As the binder resin, there are styrene or polymer of its substitution product such as polystyrene, poly-p-chlorostyrene, polyvinyl toluene etc., there are styrene copolymer such as styrene-p-chlorostyrene copolymer, styrene-methacrylate copolymer vinyltoluene copolymer, styrene-vinylenaphthalene copolymer, styrene-methyl acrylate copolymer, styrene-ethyl acrylate copolymer, styrene-butyl acrylate copolymer, styrene-octyl acrylate copolymer, and styrene-methyl methacrylate copolymer, styrene-ethyl methacrylate copolymer, styrene-butyl methacrylate copolymer, styrene-α-methyl chlormethacrylate copolymer, styrene-acrylonitrile copolymer, styrene-vinylemethylketone copolymer, styrene-butadiene copolymer, styrene-isoprene copolymer, styrene-acrylonitrile-indene copolymer, styrene-maleic copolymer, styrene-maleic ester copolymer, or there are polymethylmethacrylate, polybutyl methacrylate, polyvinyl chloride, polyvinyl acetate, polyethylene, polypropylene, polyester, epoxy resin, epoxypolyol resin, polyurethane, polyamide, polyvinyl, butyral, polyacrylate resin, rosin, denatured rosin, terpene resin, aliphatic or alicyclic hydrocarbon resin, aromatic oil resin, paraffin chloride, paraffin wax, etc., and individually or a mixture of plural ones of such can be adopted.

In the toner used in this embodiment, a charge controlling agent can be contained in accordance with necessity. As the charge controlling agent, all known ones can be used, for example nigrosine dye, tripheylmethane dye, metal complex dye containing chromium, chelate molybdate pigment, rhodamine dye, alkoxyl amine, 4th grade ammonium salt (including fluorine denatured 4th grade ammonium salt), alkylamido, single substance or chemical compound of phosphorus, single substance or chemical compound of tungsten, fluorine activator, metal salt salicylate, metal salt derivative salicylate etc., and such can be jointly used.

The amount of the charge controlling agent described above is determined on the basis of an existence or not of an addition agent which is used in accordance with necessity and a toner producing method including a dispersion method, and it is not limited to the only one condition. However, the range of the charge controlling agent is 0.1–10 parts, preferably 2–5 parts with respect to the binder resin of 100 parts. In the case of less than 0.1 parts, a charging amount of the toner becomes too little and it is not practical. In the case of more than 10 parts, the charging amount of the toner becomes too large, and thereby an electrostatic suction force with a carrier is increased, and therefore fluidity of developer or image density are reduced.

Moreover, as other addition agents to the toner, for example there are colloidal silica, hydrophobic silica, fatty acid metal salt (zinc stearate, aluminum stearate, etc.), metal oxide (titanium oxide, aluminum oxide, tin oxide, antimony oxide, etc.), fluoro polymer, etc.

Hereinafter, an example of the developer including ceramic toner of each color of Bk, C, M, and Y, and the carrier will be described.

EXAMPLE 1

[Producing an example of a mixture (a fine particle mixture) of the mineralizer, the sintering material, and the flux]

| | | | |
|---|---|---|---|
| $Na_2O$ | 1 part | | |
| $K_2O$ | | 1 | part |
| CaO | 15 parts | | |
| PbO | | 2 | parts |
| $B_2O_3$ | 13 parts | | |
| $Al_2O_3$ | | 2 | parts |
| $SiO_2$ | 35 parts | | |

The materials listed above are broken into pieces by a stamp mill and further are mixed by Henshel mixer (trademark, by Mitsui Miike Kako Co., Ltd.), and therefore a compounded fine particle mixture is obtained.

EXAMPLE 2

[Producing an example of Bk toner]

| | |
|---|---|
| polyester resin (acid value = 3, hydroxyl value = 25, Mn = 45000, Mw/Mn = 4.0, Tg = 60° C.) | 600 parts |
| $(Mn, Co)O.(Cr, Fe)_2O_3$ | 100 parts |
| compounded fine particle mixture | 300 parts |
| zinc salicylate derivative (Bontron E-87 (trademark) by Orient Chemical Co. Ltd.) | 2 parts |

The materials listed above are mixed enough by the Henshel mixer, and the mixture is cooled after three passes kneading by three rolls, and then is broken into pieces by a pulverizer, and further is broken into fine pieces by a jet mill. After that, it is classified and toner having a volume average grain size of 7.5 μm is obtained. Further, 0.5 wt % of hydrophobic silica (R972 by Nippon Aerosil Co. Ltd.) is added to this and is mixed by the mixer and then Bk toner is obtained.

EXAMPLE 3

[Producing an example of C toner]

| | |
|---|---|
| polyester resin (acid value = 3, hydroxyl value = 25, Mn = 45000, Mw/Mn = 4.0, Tg = 60° C.) | 600 parts |
| vanadium blue | 100 parts |
| compounded fine particle mixture | 300 parts |
| zinc salicylate derivative (Bontron E-87 (trademark) by Orient Chemical Co. Ltd.) | 2 parts |

The materials listed above are mixed enough by the Henshel mixer, and the mixture is cooled after three passes kneading by three rolls, and then is broken into pieces by a pulverizer, and further is broken into fine pieces by a jet mill. After that, it is classified and toner having a volume average grain size of 7.5 μm is obtained. Further, 0.5 wt % of hydrophobic silica (R972 by Nippon Aerosil Co. Ltd.) is added to this and is mixed by the mixer and then C toner is obtained.

EXAMPLE 4

[Producing example of M toner]

| | |
|---|---|
| polyester resin (acid value = 3, hydroxyl value = 25, Mn = 45000, Mw/Mn = 4.0, Tg = 60° C.) | 600 parts |
| $ZnO.(Al.Cr)_2O_3$ | 100 parts |
| the compounded fine particle mixture | 300 parts |
| zinc salicylate derivative (Bontron E-87 (trademark) by Orient Chemical Co. Ltd.) | 2 parts |

The materials listed above are mixed enough by the Henshel mixer, and the mixture is cooled after three passes kneading by three rolls, and then is broken into pieces by a pulverizer, and further is broken into fine pieces by a jet mill. After that, it is classified and toner having a volume average grain size of 7.5 μm in is obtained. Further, 0.5 wt % of hydrophobic silica (R972 by Nippon Aerosil Co. Ltd.) is added to this and is mixed by the mixer and then M toner is obtained.

EXAMPLE 5

[Producing example of Y toner]

| | |
|---|---|
| polyester resin (acid value = 3, hydroxyl value = 25, Mn = 45000, Mw/Mn = 4.0, Tg = 60° C.) | 600 parts |
| chromium titanium yellow | 100 parts |
| the compounded fine particle mixture | 300 parts |
| zinc salicylate derivative (Bontron E-87 (trademark) by Orient Chemical Co. Ltd.) | 2 parts |

The materials listed above are mixed enough by the Henshel mixer, and the mixture is cooled after three passes kneading by three rolls, and then is broken into pieces by a pulverizer, and further is broken into fine pieces by a jet mill. After that, it is classified and toner having a volume average grain size of 7.5 μm is obtained. Further, 0.5 wt % of hydrophobic silica (R972 by Nippon Aerosil Co. Ltd.) is added to this and is mixed by the mixer and then Y toner is obtained.

EXAMPLE 6

[Producing example of carrier]

| | |
|---|---|
| silicon resin solution (KR50 by Shinetsu Kagaku Co., Ltd.) | 100 parts |
| carbon black (BP2000 by Cabot Co., Ltd.) | 3 parts |
| toluene | 100 parts |

The materials listed above are dispersed by a homogenizer for 30 minutes and a forming liquid for a covering layer is compounded. This forming liquid for a covering layer is coated on surfaces of spherical ferrite of 1000 parts by a fluidized bed coating apparatus and then the carrier is obtained.

Bk developer which is completed by stirring the above carrier of 400 g and the above Bk toner of 20 g for 30 minutes is used in the Bk developing unit 14 of the above color copying machine. Similarly, C developer which is completed by stirring the above carrier of 400 g and the above C toner of 20 g for 30 minutes is used in the C developing unit 15. Moreover, M developer which is completed by stirring the above carrier of 200 g and the above M toner of 20 g for 30 minutes is used in the M developing unit 16. Further, Y developer which is completed by stirring the above carrier of 200 g and the above Y toner of 20 g for 30 minutes is used in the Y developing unit 17.

In this example, although the mixture (the fine particle mixture) of the above mineralizer, the sintering material, and the flux is added, this fine particle mixture can be added to a resin layer for protecting the toner image. Further, when the mixture is coated on a surface of the transferring object, such as a ceramic substrate, as the picture design forming object before the sintering process, it is not necessary to add the mixture to each toner.

In the toner of this embodiment, in order to obtain better sensitivity of the optical sensor 18 which is used in the control operations described below, a light absorbing material which has absorbency to light of a wavelength used in the optical sensor 18 and which resolves at a temperature of the above sintering process is contained in each toner. As described above, the material of which element becomes volatilized or a white chemical compound by resolving at high temperature is desired, namely an organic group dye/pigment which does not include metal element or includes only metal which becomes a white chemical compound, for example Li, Na, K, Ca, Ba, Al and Zn. Specifically, almost all organic dyes/pigments such as azo, anthraquinone, triphenylmethane etc., can be used, typically diazo yellow G, diazo yellow 10G, diazo yellow AAA, diazo yellow H10G, brilliant carmine 6B, brilliant fast-scarlet, naphthol red BS, naphthol carmine FB, alkali blue G, aniline black, or carbon black etc.

For example, if a LED of infrared light which has an emitting wavelength of approximately 950 nm is used as an emitting device of the optical sensor 18, the carbon black of about 8 parts which has absorbency to this infrared light is added when the toner of the each color is produced.

Next, control of the image forming apparatus based on outputs of the optical sensor 18 in the color copying machine of the structure described above will be described.

First, an electric potential control which controls charging electric potential by charger 12, an exposing electric potential by writing optical unit 8 and developing bias electric potential by each developing unit on the basis of detection result of the optical sensor 18, will be described.

Figure 3:
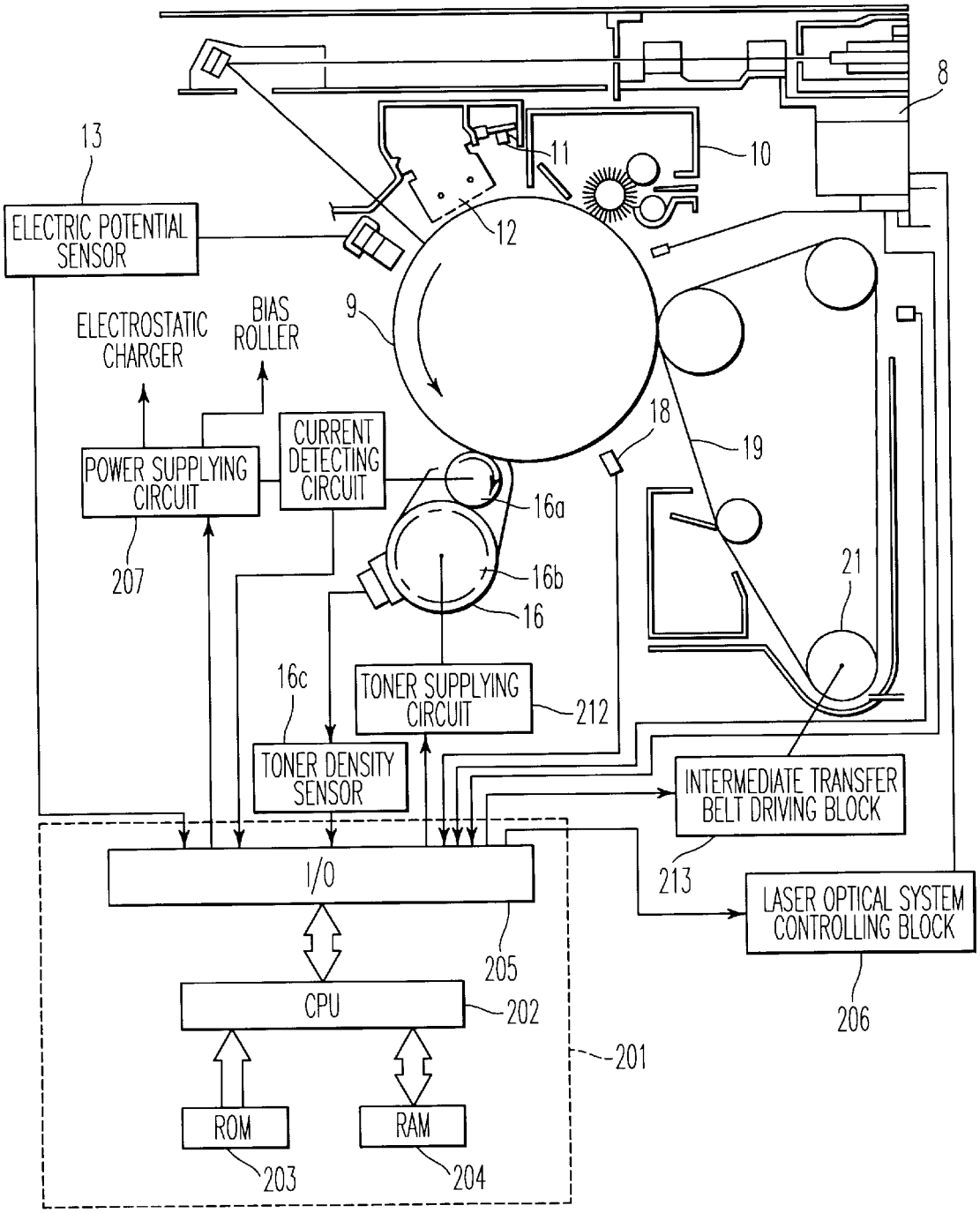
FIG. 3 shows a control system in the color copying machine of the embodiment of the present invention.

FIG. 3 shows a control system in the color copying machine of this embodiment. This system is composed of a main control block 201 and plural peripheral control blocks, and the main control block 201 is composed of a main CPU 202, a ROM 203 for storing control programs and various data, a RAM 204 for storing temporally various data as a work region, and I/O interface block 205 for inputting/outputting data from/to each peripheral control block.

Moreover, the main control block 201 is connected to a laser optical system controlling block 206, a power supplying circuit 207, an optical sensor 18 of a reflecting type, toner density sensors 14*c*–17*c*, only the example sensor 16*c* being shown in FIG. 3, an electric potential sensor 13, a toner supplying circuit 212, an intermediate transfer belt driving block 213, etc., via the I/O interface block 205. The laser optical system controlling block 206 controls the laser optical system 105 by the command of the main CPU 202. The power supplying circuit 207 applies a high voltage to the charger 12 by the command of the main CPU 202, applies a transferring bias voltage to a transferring bias roller 20*a* and a paper transferring bias roller 23*a*, and applies each developing bias voltage to the developing rollers 14*a*–17*a*, only the example roller 16*a* being shown in FIG. 3. The optical sensor 18 optically detects a reflecting density of toner density on the photoconductive drum 9 between the C developing unit 16 and the intermediate transfer belt 19. The potential sensor 13 detects a surface potential of the photoconductive drum 9 between the charger 12 and the Bk developing unit 14.

The above toner supplying circuit 212 supplies M toner to the M developing unit from the M toner supplying block (not shown in FIG. 3) under command of the main CPU 202, and similarly other toner supplying circuits (not shown in FIG. 3) supply Bk toner to the Bk developing unit 14 from the Bk toner supplying block, C toner to the C developing unit 15 from the C toner supplying block, and Y toner to the Y developing unit 16 from the Y toner supplying block by the command of the main CPU 202. The intermediate transfer belt driving block 213 rotates the intermediate transfer belt 19 under command of the main CPU 202.

In the color copying machine of this embodiment, the following electric potential control operations are executed when the apparatus starts by power on. However, such control operations can be executed every predetermined copying sheet volume or every constant time in accordance with necessity.

Figure 4:
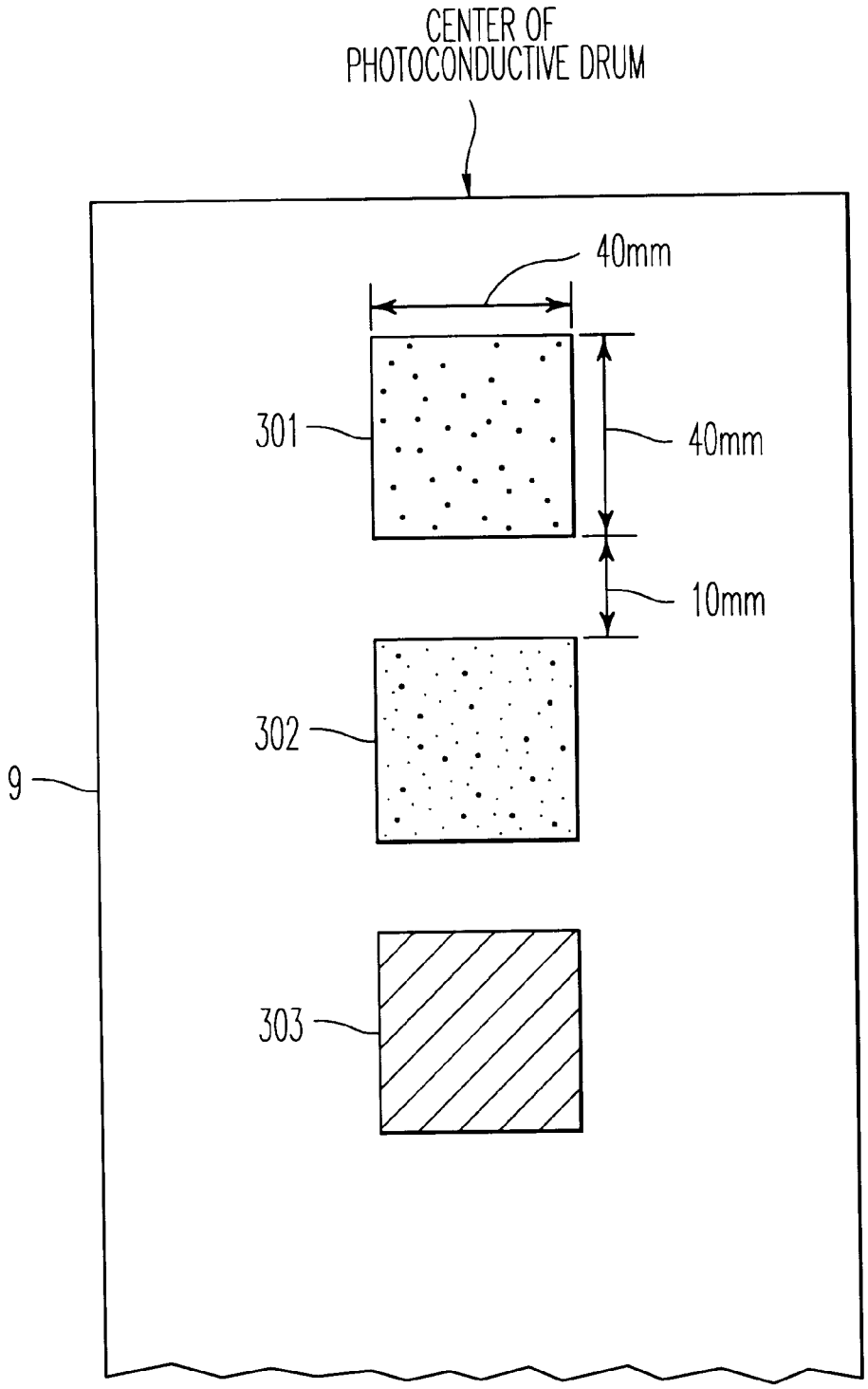
FIG. 4 shows a patch pattern for controlling the color copying machine in the embodiment of the present invention.
Figure 5A:
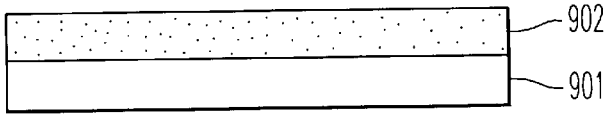
FIG. 5A BACKGROUND ART
FIGS. 5(*a*)–5(*f*) show a forming method of a transferring substance and a picture design forming method onto a substrate using the transferring substance.
Figure 5B:
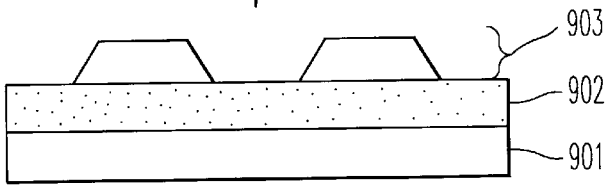
FIG. 5B BACKGROUND ART
Figure 5C:
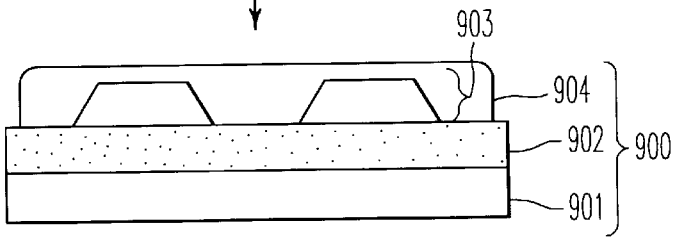
FIG. 5C BACKGROUND ART
Figure 5D:
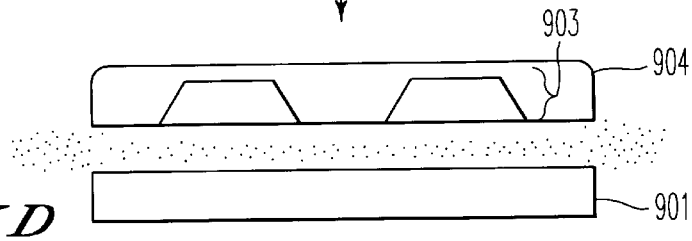
FIG. 5D BACKGROUND ART
Figure 5E:
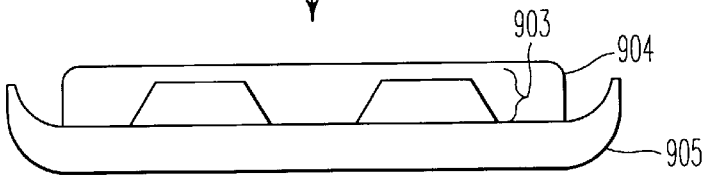
FIG. 5E BACKGROUND ART
Figure 5F:
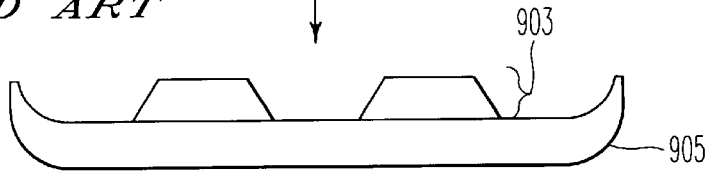
FIG. 5F BACKGROUND ART
Figure 6:
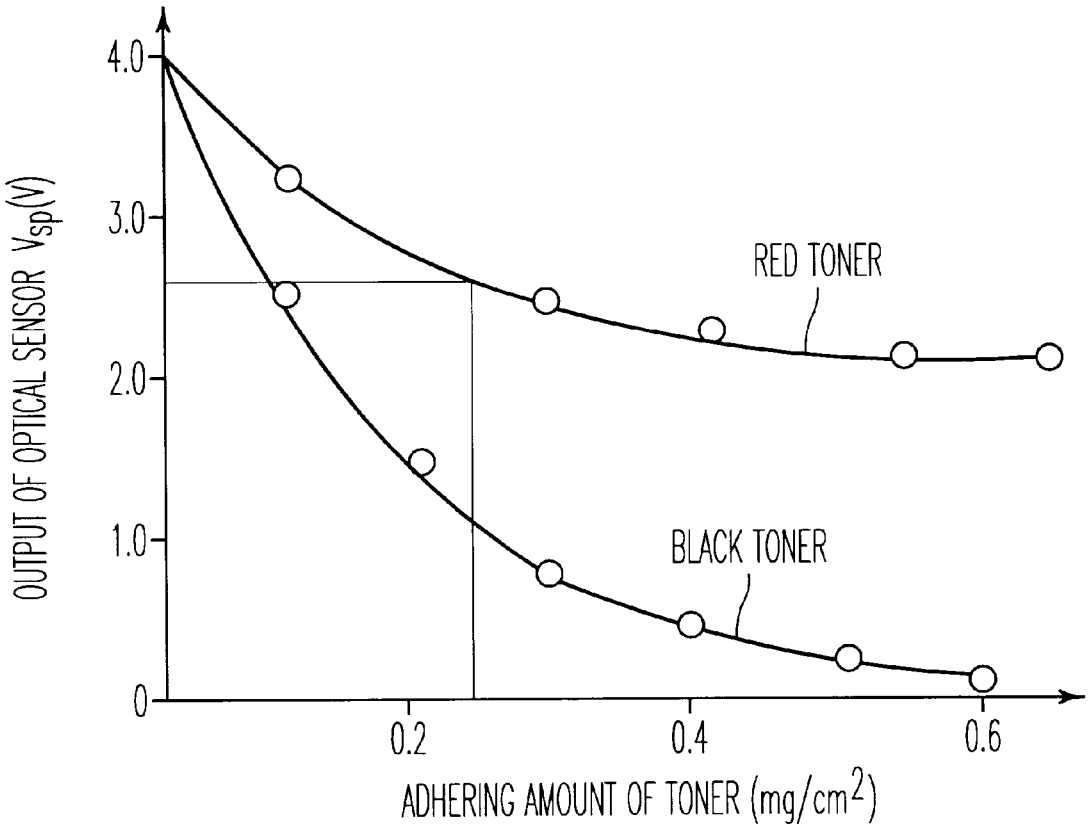
FIG. 6 is a graph showing a relation between an adhering amount of a toner and an output Vsp of an optical sensor.

In the electric potential control in this embodiment, at first, the potential sensor 13 is proofread and the optical sensor 18 is adjusted so that an output value Vsg of the optical sensor 18 to the photoconductive drum 9 is a constant value. Next, a latent image pattern as shown in FIG. 4 is formed on the photoconductive drum 9. In FIG. 4, in a center portion of a width direction, the latent images 301, 302, 303 . . . which have N numbers of gradation densities (N numbers of latent image patterns) are formed at a predetermined interval across a rotation direction of the photoconductive drum 9, for example 10 numbers of rectangular latent image patterns 301, 302, 303 . . . each having a side of 40 mm and a different density are formed at 10 mm intervals. Output values of the potential sensor 13 to those latent images 301, 302, 303 . . . are read and stored in the RAM 204.

Next, the latent image patterns 301, 302, 303 . . . of four colors on the photoconductive drum 9 are developed at every color by the Bk developing unit 14, the C developing unit 15, the M developing unit 16 and the Y developing unit 17, and then a toner image of each color is completed. Output values of the potential sensor 13 to these completed toner images are read and stored as Vpi (i=1–N) in the RAM 204 for every color.

In this embodiment, the photoconductive drum 9 is charged uniformly by the charger 12, and the latent image patterns 301, 302, 303 . . . are formed by changing an optical output of the optical writing unit 8 by the laser optical system controlling block 206. However, operations are not limited to this method, and the latent images can be formed by changing the developing bias potential of each developing unit 14–17.

Next, the main control block 201 converts an output of the value of the optical sensor 18 to an adhering amount of toner per unit area by referring to a conversion table stored in the ROM 203, and such an adhering amount is stored in the RAM 204.

Next, in order to correct an output saturation property of the optical sensor 18 in a portion where a large amount of toner adhered, by using an electric potential data of the above each latent image pattern obtained in the potential sensor 13, an approximate straight line equation which approximates a relation (developing property) of both data as a straight line is sought with respect to each color. By using this approximate straight line equation, each target controlling value of charging electric potential VD by the charger 12 with respect to each color, of exposing electric potential VL by the optical writing unit 8, and of developing bias electric potential VB, are sought.

Next, the main control block 201 and the laser optical system controlling block 206 control the system so that the laser emitting power of the optical writing unit 8 is a maximum, and residual electric potential is detected by inputting the output value of the potential sensor 13. Then, if the residual electric potential is not zero, the target potentials VB, VD and VL determined above are corrected for the amount of the residual electric potential, and therefore they become the target electric potential. Finally, the power supplying circuit 207 is adjusted so that the charging electric potential of the photoconductive drum 9 by the charger 12 is the above target electric potential VD, and the laser emitting power is adjusted via the laser optical system controlling block 206 so that the exposing electric potential on the photoconductive drum 9 becomes the target electric potential VL, and the power supplying circuit 207 is adjusted so that each developing bias electric potential of the Bk developing unit, of the C developing unit, of the M developing unit, and of the Y developing unit, becomes the above target electric potential VB.

Moreover, the developing property calculated by the electric potential control on the basis of the detecting result of the above optical sensor 18 is also used in toner supplying control on the basis of the detection result of the optical sensor 18 which is executed after every image forming operation. As described above, the optical sensor 18 is used in both the electric potential control and the toner supplying control on the basis of a calculation of the developing property.

As described above, according to this embodiment, since the developing property in each developing unit is directly calculated by the above control, various optimum electric potentials (the charging electric potential, the exposing electric potential, and the developing bias potential) can be obtained and optimum conditions for toner supplying can be decided, and therefore a high quality color toner image can be formed on the transferring medium used for forming the picture design.

Moreover, according to this embodiment, since carbon black, which has an absorbency to infrared light of a wavelength of approximately 970 nm which is mainly used in the optical sensor 18, is contained in the toner, when in the above control the adhering amount of the toner (optical density) of the pattern for controlling which is formed on the photoconductive drum 9 is detected by the optical sensor 18, the adhering amount of toner can be detected sensitively and stably with respect to each color toner.

Further, according to this embodiment, in the color copying machine of the above structure, the color toner image on the transferring medium may not be the desired color tone, however the carbon black contained in each toner is resolved by high temperature heating. Therefore, when the sintering process with high temperature heating is executed in the state that the color toner image is attached on the surface of the picture design forming object, such as a ceramic substrate, the carbon black in the toner is resolved and volatilized. Therefore, the picture design which is finally formed on the picture design forming object, such as the ceramic substrate, does become the desired color tone.

Finally, the technical advantages of the present invention will be described.

According to the picture design forming method of the present invention, when a toner image for forming a picture design is formed on a picture design forming object, an adhering amount of toner on a member is detected by an optical sensor, and based on this detection result image forming conditions are controlled. Thereby, image forming conditions can be set to optimum conditions and a toner image of a desired image quality can be formed.

Moreover, in the above control, the toner used for the toner image which is detected by the optical sensor contains a light absorbing material which has absorbency to a wavelength which is used mainly by the optical sensor. Thereby, the adhering amount of the toner image can be detected sensitively and the above control can be executed stably.

Further, the light absorbing material contained in the toner used for the toner image becomes resolved and volatilized, or becomes a white color, at a sintering process temperature when the toner image is sintered as the toner is being attached on a surface of the picture design forming object. Thereby, a quality of the picture design which is finally formed on the picture design forming object is not reduced by the light absorbing material.

The toner for forming an image of the present invention contains at least a thermal sintering colorant, a binder resin and the light absorbing material which is resolved at the sintering process temperature, and by using this toner the toner image is formed, and this toner image is attached on the picture design forming object, and it is sintered. Thereby the picture design can be formed on the true design forming object.

Further, by utilizing toner which has absorbency to a wavelength which is used mainly by the optical sensor, the toner image for controlling is formed. Thereby, the adhering amount of the toner image can be detected sensitively and control of the image forming conditions can be executed stably.

Especially, a color tone of the above thermal sintering colorant after sintering may be black, yellow, magenta or cyan, and these are superposed and the toner image is formed, and the toner image is attached on the picture design forming object and is sintered. Thereby, a plural color image can be formed on the picture design forming object.

According to the transferring substance for forming the picture design forming toner, the toner image which is formed by the toner which contains light absorbing material which is resolved at the sintering process temperature is attached on the picture design object and is sintered. Thereby, the picture design can be formed on the picture design object.

Moreover, the light absorbing material contained in the toner used for the toner image becomes resolved and volatilized, or becomes a white color, on the sintering process. Thereby, a quality of the picture design which is finally formed on the picture design forming object is not reduced by the light absorbing material.

Especially, three kinds of toners having color tones after sintering of yellow, magenta, or cyan are superposed and the toner image is formed, and the toner image is attached on the picture design forming object and is sintered. Thereby, a plural color image can be formed on the picture design forming object.

According to the picture design forming apparatus of the present invention, when the toner image is formed on the picture design forming object, the adhering amount of the toner on the member is detected by the optical sensor, and based on this detection result image forming conditions are controlled. Thereby, the image forming conditions can be set to optimum conditions and a toner image of a desired image quality can be formed.

Moreover, in the above control, the toner used for the toner image which is detected by the optical sensor contains light absorbing material which has absorbency to a wavelength which is used mainly by the optical sensor. Thereby, the adhering amount of the toner image can be detected sensitively and the above control can be executed stably.

Further, when the toner image is formed for forming the picture design, the light absorbing material contained in the toner used for the toner image becomes resolved and volatilized, or becomes a white color, at a sintering process temperature when the toner image is sintered as the toner is attached on a surface of the picture design forming object. Thereby, a quality of the picture design which is finally formed on the picture design forming object is not reduced by the light absorbing material.

Obviously, numerous additional modifications and variations of the present invention are possible in light of the above teachings. It is therefore to be understood that, within the scope of the appended claims, the present invention may be practiced otherwise than as specifically described herein.

What is claimed as new and desired to be secured by letters patent of the United States is:

1. A picture design forming method comprising the steps of:

detecting an adhering amount of toner by an optical sensor in an image forming apparatus;

controlling at least one image forming condition based on the detection result;

forming a toner image on a member;

transferring the toner image to a transferring substance;

attaching the transferring substance to a picture design forming object;

sintering the picture design forming object including the transferring substance, wherein a light absorbing material which has an absorbency to light of a wavelength used in the optical sensor is contained in the toner, and the step of sintering resolves the light absorbing material at least at a temperature of the sintering.

2. The picture design forming method according to claim 1, wherein in the step of forming the toner image on the member, plural kinds of toner are superposed on one another on the member.

3. The picture design forming method according to claim 2, wherein the plural kinds of toner include toners of color tones of yellow, magenta and cyan after the step of sintering.

4. Toner for forming an image in a system in which an adhering amount of toner is detected by an optical sensor, comprising:

thermal sintering colorant;

binder resin;

light absorbing material which has an absorbency to light of a wavelength used in the optical sensor and which resolves at least at a temperature of a sintering of the toner.

5. The toner of claim 4, wherein the thermal sintering colorant is such that a color tone after the sintering is black.

6. The toner of claim 4, wherein the thermal sintering colorant is such that a color tone after the sintering is yellow.

7. The toner of claim 4, wherein the thermal sintering colorant is such that a color tone after the sintering is magenta.

8. The toner of claim 4, wherein the thermal sintering colorant is such that a color tone after the sintering is cyan.

9. A transferring substance for forming a picture design having a toner image, wherein toner forming the toner image comprises:

thermal sintering colorant;

binder resin;

light absorbing material which has an absorbency to light of a wavelength used in the optical sensor and which resolves at least at a temperature of a sintering of the toner.

10. The transferring substance for forming a picture design of claim 9, where the toner image is formed by superposing three kinds of toner including toners of color tones of yellow, magenta and cyan after the sintering.

11. An image forming apparatus which forms an image on a member by toner, detects an adhering amount of the toner on the member by an optical sensor, and controls at least one image forming condition on the basis of the detection result, wherein the toner comprises:

thermal sintering colorant;

binder resin; and light absorbing material which has an absorbency to light of a wavelength used in the optical sensor, and which resolves at least at a sintering temperature of the toner.

12. The image forming apparatus of claim 11, wherein the thermal sintering colorant is such that a color tone after the sintering is black.

13. The image forming apparatus of claim 11, wherein the thermal sintering colorant is such that a color tone after the sintering is yellow.

14. The image forming apparatus of claim 11, wherein the thermal sintering colorant is such that a color tone after the sintering is magenta.

15. The toner of claim 11, wherein the thermal sintering colorant is such that a color tone after the sintering is cyan.

* * * * *